US006364969B1

(12) United States Patent
Couper

(10) Patent No.: US 6,364,969 B1
(45) Date of Patent: Apr. 2, 2002

(54) 6XXX SERIES ALUMINIUM ALLOY

(76) Inventor: Malcolm James Couper, 49 Oronsay Crescent, Diamond Creek, Victoria (AU), 3089

( * ) Notice: Subject to any disclaimer, the term of this patent is extended or adjusted under 35 U.S.C. 154(b) by 0 days.

(21) Appl. No.: 09/147,453

(22) PCT Filed: Jul. 4, 1997

(86) PCT No.: PCT/AU97/00424

§ 371 Date: Oct. 12, 1999

§ 102(e) Date: Oct. 12, 1999

(87) PCT Pub. No.: WO98/01591

PCT Pub. Date: Jan. 15, 1998

(30) Foreign Application Priority Data

Jul. 4, 1996 (AU) ..... PO 0847

(51) Int. Cl.[7] ..... C22C 21/08

(52) U.S. Cl. ..... 148/415; 148/550; 420/544; 420/546

(58) Field of Search ..... 148/417, 415, 148/552, 550; 420/544, 546

(56) References Cited

U.S. PATENT DOCUMENTS 3,642,542 A * 2/1972 Sperry et al. ..... 148/12.7
4,039,355 A * 8/1977 Takahashi et al. ..... 148/31.5
4,525,325 A * 6/1985 Livak ..... 420/535
4,661,172 A * 4/1987 Skinner et al. ..... 148/12.7
4,844,750 A * 7/1989 Cho et al. ..... 148/12.7
4,909,861 A * 3/1990 Muraoka et al. ..... 148/12.7
5,223,050 A * 6/1993 Bryant et al. ..... 148/415
5,266,130 A * 11/1993 Uchida et al. ..... 148/552
5,527,404 A * 6/1996 Warren ..... 148/688

FOREIGN PATENT DOCUMENTS

EP 302623 * 2/1989
EP 714 993 6/1996

OTHER PUBLICATIONS

"ASM Handbook: Alloy Phase Diagrams" vol. 3, ASM International, (1992), p. 282.*

* cited by examiner

*Primary Examiner*—George Wyszomierski
*Assistant Examiner*—Janelle Combs-Morillo
(74) *Attorney, Agent, or Firm*—Miles & Stockbridge P.C.; John C. Kerins

(57) ABSTRACT

A 6XXX series aluminium alloy containing Mg and Si is disclosed. The 6XXX series aluminium alloy is characterized in that the Mg and Si that is available to form MgSi precipitates is present in amounts such that the ratio of Mg:Si, on an atomic weight basis, is between 0.8:1 and 1.2:1.

9 Claims, 1 Drawing Sheet

6XXX SERIES ALUMINIUM ALLOY

Figure 1:
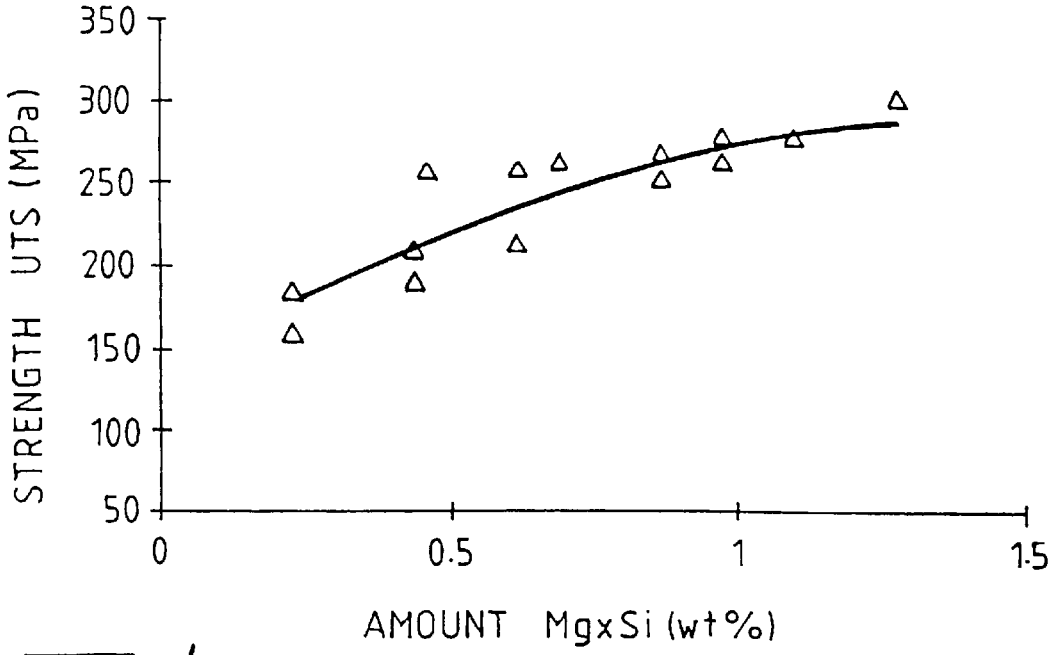

The present invention relates to aluminium alloys of the 6XXX series, to methods of processing such alloys and to a method for designing such alloys.

The 6XXX series aluminium alloys are aluminium based alloys that include magnesium (Mg) and silicon (Si), with the Mg and Si each generally being present in the range of 0.2 to 1.5% by weight.

The 6XXX series alloys are widely used in applications which require medium-high strength with good formability, weldability and extrudability. The applications include a wide range of architectual/structural/electrical applications. Typically, the 6XXX alloys are cast as billets and then extruded to form small round bars or other profiled shapes or forged (from extrusions or billets) into larger components.

Conventional theories of precipitation hardening in 6XXX series alloys state that hardening occurs via the precipitation and growth of $Mg_2Si$ in accordance with the following sequence:

i) Si atom clusters form during delay before ageing;

ii) GPI zones form during heat up to ageing temperature, iii) GPII zones form-precipitation of β" $Mg_2Si$;

iv) β' precipitate forms via transformation from β" and grows with the amount of β' depending upon the temperature and time; and v) if overageing occurs, β $Mg_2Si$ precipitate forms.

As a consequence of the conventional theories that the ratio of Mg to Si in the precipitates that form in 6XXX alloys is approximately 2 (on an atomic weight basis), in order to produce alloys that are "balanced" with respect to Mg and Si, the standard practice has been to calculate the relative amounts of Mg and Si to add to 6XXX alloys so that the alloys include atomic weight ratios of Mg:Si of 2:1.

In some instances, instead of forming balanced alloys, it is known to design 6XXX alloys to contain excess Si to increase the strength thereof. In this instance any Si that does not precipitate as $Mg_2Si$ or does not form intermetallics is free to form other phases, such as precipitates with other elements, which have an added strengthening effect. The level of excess Si is varied to produce the desired strengthening effect—with the limit of Si addition often being determined by factors such as the effect of Si addition on extrudability.

Other alloying element additions and heat treatment sequences of the 6XXX alloys are also predicated on the precipitation of $Mg_2Si$. For example, maganese (Mn) can be added to alloys to produce a distribution of Mn which acts as heterogenous nucleation sites and increases the chance of forming β' $Mg_2Si$ rods. This significantly increases the flow stress for extrusion, but also increases the level of pinning of grain boundaries, and thus reduces or even prevents recrystallisation and course grain band formation.

There are a wide range of different options for processing cast billets of 6XXX alloys to manufacture final extruded or forged products.

By way of example, it is known to homogenise 6XXX series billets to dissolve the maximum possible amount of Mg and Si present as intermetallics at grain boundaries in the as-cast billets, producing a supersaturated solid solution which, upon cooling, produces uniform precipitation of intermetallics and $Mg_2Si$. It also breaks up the cast structure and transforms AlFeSi intermetallics. This leads to greater uniformity of flow stress and final properties of the extrusions and allows the development of full mechanical properties. Typically, slow cooling rates, such as 100–200° C./hour, are used.

Moreover, it is known to use induction heating to heat billets quickly to required temperatures before extrusion. Typically, gas heating is used to bring the billets to approximately 300° C. and induction heating is used to complete heating billets to the extrusion temperatures. The rapid heat-up rate with induction heating does not allow sufficient time for β' $Mg_2Si$ precipitates to grow, and thus provides a fine dispersion for extrusion. Flow stresses are thus considerably reduced. Similarly, it is possible to maintain the same properties whilst using a substantially lower billet temperature, also allowing faster extrusion speeds to be used.

Furthermore, it is known to vary post-extrusion quenching rates depending on the alloy being extruded. A desirable feature of an alloy is that it has a low quench sensitivity, i.e. it can reach full properties with slow cooling. The benefits of this are that distortion can be minimised, properties are more uniform, and quenching equipment is not required.

There is a range of known practices for alloy selection, homogenisation, billet heating and quenching, and these are largely empirical optimisations within the boundaries of commonly used alloy systems. By way of example, practices, such as step cooling, slow cooling and fast cooling, are recommended after homogenisation.

Typical alloy specifications are provided in Table 1 for several alloys of the 6XXX series:

TABLE 1

Alloy specifications for several 6XXX series aluminium alloys. From "Aluminium Standards, Data and Design Wrought Products", the Aluminium Council of Australia.

| | Composition (wt %) | | | | | | | |
|---|---|---|---|---|---|---|---|---|
| Alloy | Si | Fe | Cu | Mn | Mg | Cr | Zn | Ti |
| 6060 | .3–.6 | .1–.3 | .1 | .1 | .35–.6 | .05 | .15 | .1 |
| 6063 | .2–.6 | .35 | .1 | .1 | .45–.9 | .1 | .1 | .1 |
| 6061 | .4–.8 | .7 | .15–.4 | .15 | .8–1.2 | .04–.35 | .25 | .15 |
| 6082 | .7–1.3 | .5 | .1 | .4–.1 | .6–1.2 | .25 | .2 | .1 |
| 6101 | .3–.7 | .5 | .1 | .03 | .35–.8 | .03 | .1 | — |
| 6262 | .4–.8 | .7 | .15–.4 | .15 | .8–1.2 | .04–.14 | .25 | .15 |
| 6351 | .7–1.3 | .5 | .1 | .4–.8 | .4–.8 | — | .2 | .2 |

In the above table, unless ranges are stated, the amounts stated are maximum concentrations.

It has been discovered recently that age hardening of 6XXX series alloys does not occur by precipitation of $Mg_2Si$—as has been previously accepted throughout the industry—but rather occurs via the precipitation of MgSi.

The discovered MgSi precipitation mechanism involves the nucleation and growth of β' MgSi precipitate with an Mg:Si ratio of 1 (atomic weight basis), and not 2 as previously believed, and comprises the following sequence:

i) formation of separate clusters of Mg and Si atoms;

ii) co-clustering of Mg and Si atoms, with the Mg:Si ratio increasing during low temperature ageing and eventually reaching 1;

iii) formation of small precipitates of unknown structure with a Mg:Si ratio close to 1;

iv) transformation of these precipitates to β" MgSi, with the ratio being 1; and formation of β' and B' in the next stage of ageing, with the ratio of Mg and Si being 1.

One consequence of the above discovery is that current commercial 6XXX alloys that have been produced in accordance with conventional theories on the basis that they are balanced with respect to Mg and Si, i.e with Mg and Si precipitating as $Mg_2Si$, in fact are not balanced.

Moreover, significantly, the applicant has found that better properties can be obtained with 6XXX alloys that are balanced with respect to Mg and Si, as this is now understood by the applicant. The properties of interest include, by way of example, extrudability, forgeability, conductivity, strength, and machinability.

According to the present invention there is provided a 6XXX series aluminum alloy containing Mg and Si which is characterised in that the Mg and Si that is available to form MgSi precipitates is present in amounts such that the ratio of Mg:Si, on an atomic weight basis, is between 0.8:1 and 1.2:1.

It is understood that for any given 6XXX series aluminium alloy the amount of Mg and Si that will be available to form Mg/Si precipitates will be less than the total amount of these elements added to the alloy composition. The reason for this is that there will always be a proportion (typically, relatively small) of the Mg and Si that remains in solution and a proportion of the Mg and Si that precipitate with other elements, such as iron (Fe) and copper (Cu), added to the alloys.

It is also understood herein that a 6XXX series aluminium alloy having Mg and Si that is available to form MgSi precipitates in amounts such that the ratio of MgSi is between 0.8:1 and 1.2:1 is a "balanced" alloy with respect to Mg and Si and is in accordance with the discovered MgSi precipitation mechanism.

It is preferred that the ratio of Mg:Si be between 0.9:1 and 1.1:1.

It is preferred particularly that the ratio of Mg:Si be 1:1.

According to the present invention there is also provided a method of manufacturing an extruded product from a 6XXX series aluminium alloy which comprises the steps of:

i) casting a billet of a 6XXX series aluminum alloy containing Mg and Si as described above;

ii) extruding a final product shape from the billet; and iii) heat treating the extruded product shape to precipitate MgSi.

The heat treatment step may be any suitable heat treatment.

According to the present invention there is also provided a method of manufacturing a forged product from a 6XXX series aluminum alloy which comprises the steps of:

i) casting a billet of a 6XXX series aluminium alloy containing Mg and Si as described above;

ii) forging a final product shape from the billet; and iii) heat treating the alloy to precipitate MgSi.

The heat treatment step may be any suitable heat treatment.

The method described in the preceding paragraph may comprise extruding an intermediate product shape from the billet and thereafter forging the final product shape.

In order to investigate the present invention the applicant carried out a series of experiments and computer modelling on the 8 6XXX series aluminium alloys set out in Table 2 and 3 other 6XXX series aluminium alloys I, J and K with nominal Mg concentrations of 0.48 wt %, ϵi concentrations of 0.8, 1.0 and 1.2 wt %, respectively, and concentrations of other elements of the order of the concentrations set out in Table 2.

TABLE 2

| | Alloy compositions | | | | | | | |
|---|---|---|---|---|---|---|---|---|
| | A | B | C | D | E | F | G | H |
| Al | Bal | Bal | Bal | Bal | Bal | Bal | Bal | Bal |
| Si | 0.39 | 0.53 | 0.27 | 0.40 | 0.49 | 0.77 | 0.62 | 0.84 |
| Mg | 0.48 | 0.70 | 0.49 | 0.72 | 0.47 | 0.74 | 0.48 | 0.67 |
| Ti | 0.016 | 0.020 | 0.009 | 0.012 | 0.014 | 0.020 | 0.015 | 0.028 |
| Fe | 0.12 | 0.15 | 0.10 | 0.12 | 0.13 | 0.22 | 0.12 | 0.12 |
| Other | 0.05 max | 0.05 max | 0.05 max | 0.05 max | 0.05 max | 0.05 max | 0.05 max | 0.05 max |

Table 3 is a summary of the processing conditions for the alloys and the subsequent heat treatment.

TABLE 3

| Processing Conditions | |
|---|---|
| Processing Step | Comments |
| Casting | VDC (vertical direct chill) cast billet ϕ 178 mm billet |
| Homogenisation | homogenised at 570° C. for 2 hr Billet diameter was reduced to ϕ127 mm by machining after homogenisation |
| Preheat | Preheat to billet temperature 450° C. |
| Extrusion | Extrude using a 880 US t Cheng Hua press Extrusion ratio: (1:56), cross-section profile dimensions: 40 mm × 6 mm Die & Container Temperature: 430° C. Extrudate exit speed: 20–40 m/min |
| Heat treatment | T4 T5 T6 |

The experimental work established that there is a general improvement in properties as the amount of MgSi increased. This is illustrated in FIG. 1 which is a graph of tensile strength versus wt % MgSi derived from the experimental work. The relationship between yield stress and wt % MgSi followed a similar trend.

Figure 2:
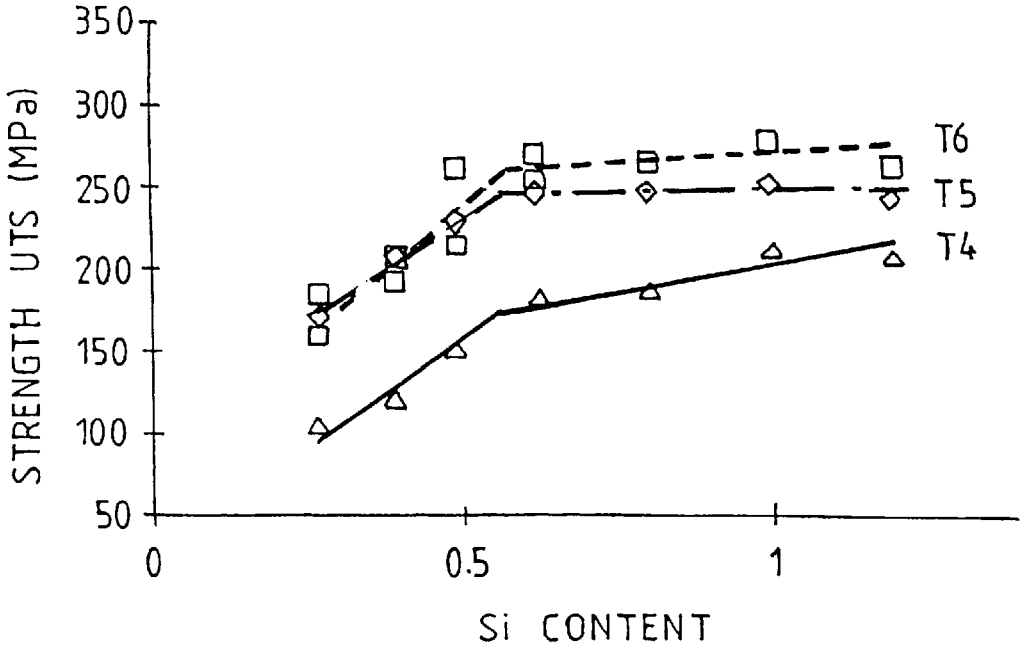

The experimental work also established that optimum properties are obtained by selecting the composition of alloys to form a "balanced" alloy in accordance with the discovered MgSi precipitation mechanism. This is illustrated in FIG. 2 which is a graph of tensile properties versus Si concentrations derived from experimental work on alloys A, C, E, I, J and K noted above all of which have Mg concentrations of the order of 0.48 wt %. Samples of the alloys were subjected to T4, T5 and T6 heat treatment sequences, and the tensile properties of the alloys were measured and plotted against the Si concentration.

FIG. 2 shows that, for each heat treatment sequence, there was a significant increase in tensile strength with increasing concentration of Si until a Si concentration of the order of 0.5–0.6 wt % was reached—which corresponds to a balanced alloy in accordance with the discovered MgSi precipitation mechanism for the alloy compositions tested—and that as the Si concentration increased further there were only marginal improvements in tensile properties. In other words, the experimental work established that the formation of a balanced alloy makes a significant contribution to tensile properties and excess Si, whilst producing an increase in tensile properties, does not have a significant effect. This is a significant finding because in many applications the tensile properties obtained with a balanced alloy will be sufficient and therefore excess Si will not be required, and the difficulties extruding alloys with high levels of Si will be avoided.

In general terms, the experimental work established that in many instances the discovered MgSi precipitation mechanism makes it possible to reduce the alloy element additions from the levels that were previously made, without reducing the properties of the alloys and, in many instances, improving the properties. With regard to the latter point, given that extrudability and conductivity generally decrease with increasing alloy element addition, it follows that there are significant advantages in minimising alloy element additions.

In other experimental work the applicant found that balanced alloys in accordance with the discovered precipitation mechanism provide better resistance to overaging and elevated temperature than concentration excess Si alloys.

The present invention has a wide range of applications including, but not limited to, the following applications:

1) General purpose alloys

Table 4 presents Mg and Si contents in accordance with the present invention for general purpose 6XXX series aluminium alloys based on the discovered MgSi precipitation mechanism.

TABLE 4

Proposed Mg and Si levels for general purpose aluminium alloys based on the discovered MgSi precipitation mechanism.

| Balanced | |
|---|---|
| Mg | Si |
| 0.37–0.44 | 0.56–0.63 |
| 0.53–0.64 | 0.75–0.84 |
| 0.70–0.83 | 0.92–1.07 |
| 0.86–1.00 | 1.10–1.29 |

Thus, in a further aspect, the present invention provides an alloy composition comprising:

| | |
|---|---|
| Mg | 0.37–0.44 |
| Si | 0.56–0.63 |
| Fe | 0.2 max |
| Cu | 0.1 max |
| Mn | 0.1 max |
| Cr | 0.05 max |
| Zn | 0.15 max |
| Ti | 0.1 max |
| Balance | aluminium and incidental impurities. |

In another aspect, the invention provides an alloy composition comprising:

| | |
|---|---|
| Mg | 0.53–0.64 |
| Si | 0.75–0.84 |
| Fe | 0.2 max |
| Cu | 0.1 max |
| Mn | 0.1 max |
| Cr | 0.05 max |

-continued

| | |
|---|---|
| Zn | 0.15 max |
| Ti | 0.1 max |
| Balance | aluminium and incidental impurities. |

In another aspect, the invention provides an alloy composition comprising:

| | |
|---|---|
| Mg | 0.70–0.83 |
| Si | 0.92–1.07 |
| Fe | 0.2 max |
| Cu | 0.1 max |
| Mn | 0.1 max |
| Cr | 0.05 max |
| Zn | 0.15 max |
| Ti | 0.1 max |
| Balance | aluminium and incidental impurities. |

In another aspect, the invention provides an alloy composition comprising:

| | |
|---|---|
| Mg | 0.86–1.00 |
| Si | 1.10–1.20 |
| Fe | 0.2 max |
| Cu | 0.1 max |
| Mn | 0.1 max |
| Cr | 0.05 max |
| Zn | 0.15 max |
| Ti | 0.1 max |
| Balance | aluminium and incidental impurities. |

2) Electrical conductor alloys.

These alloys are traditionally overaged to ensure that all Mg and Si are precipitated from the matrix as β $Mg_2Si$. This maximises conductivity through the matrix. However, to compensate for the loss of properties due to overageing, larger sections are needed to maintain strength.

It is not understood, based on existing understanding of the age hardening process, why the peak aged condition with semi coherent β' (which occupies a similar volume fraction to the incoherent β) does not have as low a resistivity as the overaged condition. Using the discovered MgSi mechanism, it is apparent that $Mg_2Si$ "balanced" alloys have an excess of Mg, which remains in the matrix in the peak aged condition, and this reduces conductivity.

With a properly balanced alloy in accordance with the discovered MgSi precipitation mechanism, there is no need to overage to ensure all Mg and Si are out of solution —the peak aged condition satisfies this requirement. With the greater strength provided by this condition, smaller sections can be used, e.g. lighter weights cables requiring less posts or smaller underground ducts.

Thus, in accordance with another aspect, the invention provides an alloy composition comprising:

i) Mg and Si concentrations inside an area bounded by the following co-ordinates on a Mg/Si co-ordinate diagram, with straight lines connecting the co-ordinates:

| Mg | Si |
|---|---|
| 0.35 | 0.48 |
| 0.35 | 0.58 |
| 0.44 | 0.7 |
| 0.58 | 0.7; and |
| ii) the following elements: | |
| Fe | 0.1–0.2 |
| Cu | 0.1 max |
| Mn | 0.03 max |
| Cr | 0.03 max |
| Zn | 0.10 max |
| B | 0.06 max |
| Balance | aluminium and incidental impurities (0.05 max each, 0.10 max total) |

3) Free machining alloys

Alloy 6262 is designed to be an $Mg_2Si$ "balanced" alloy with Pb and Bi additions to improve its machinability. The effectiveness of these additions is reduced by the loss of Bi to hard BiMg particles. Because the alloy is thought to be $Mg_2Si$ balanced, the formation of detrimental $Bi_2Mg_3$ is considered to be unavoidable.

However, on the basis of the discovered MgSi precipitation mechanism, there is in fact excess Mg in this alloy. Therefore, by reducing the Mg content, the formation of $Bi_2Mg_3$ can be avoided, thereby improving machinability. Furthermore, lower Pb/Bi additions can be used for the same machinability, this being more environmentally friendly and making recycling easier.

4) Higher strength alloys containing Cu additions.

Additions of Cu are known to produce increases in strength of 6XXX alloys.

Cu is not added to $Mg_2Si$ excess Si alloys (6351,6082) in amounts greater than 0.1% because of corrosion problems. However, since these alloys are in fact close to being MgSi balanced, the strengthening effect of AlCuMg is not being realised. Instead, the Cu probably forms coarse precipitates that reduce corrosion resistance. Therefore, by adding more Mg, more Cu can be added to increase the strength without detrimental corrosion effects.

In order to investigate further the application of the present invention to high strength alloys containing Cu additions the applicant carried out a series of experiments on 3 6061 alloy compositions set out in Table 5.

TABLE 5

| | 6061 alloys | | |
|---|---|---|---|
| Element | B | A | C |
| Al | Bal | Bal | Bal |
| Si | 0.70 | 0.62 | 0.80 |
| Fe | 0.19 | 0.20 | 0.20 |
| Cu | 0.35 | 0.25 | 0.30 |
| Mn | 0.01 | 0.13 | 0.01 |
| Mg | 1.06 | 0.87 | 0.80 |
| Cr | 0.05 | 0.11 | 0.05 |
| Ti | 0.02 | 0.02 | 0.015 |

The alloys had ratios, based on atomic weight, of Mg and Si available for precipitation as MgSi that decreased from alloy A to alloy C.

The alloys A and B are commercially available alloys. The alloy C was selected as a balanced alloy on the basis of the discovered MgSi mechanism.

The 6061 alloys were homogenised, forged to form 3 different parts, and subjected to a T6 heat treatment.

The tensile strength and hardness properties of the alloys were measured after the T6 treatment. Table 6 is a summary of the results.

TABLE 6

| | Properties of 6061 alloys | | |
|---|---|---|---|
| | A | B | C |
| Part 1 | — | 118 Vickers (equiv HRH 110), UTS 325 Mpa | 126 Vickers (equiv HRH > 110), UTS 352 Mpa |
| Part 2 | 109 Vickers (equiv HRH 108) US 306 Mpa | 120 Vickers (equiv HRH 110), UTS 345 Mpa | — |
| Part 3 | — | — | 113 Vickers (equiv HRH 109) |

The results in Table 6 indicate that the tensile strength and hardness properties of alloy C, which is balanced in accordance with the discovered MgSi mechanism, were better than that of the conventional alloys A and B.

As noted above, the present invention also provides methods for processing 6XXX series aluminium alloys. Process variability may be minimised by supplying material in the condition least sensitive to subsequent processing, using an appropriate choice of Mg:Si ratio. In order to fully realise this, and other benefits of the discovered MgSi precipitation mechanism, at least one of the following alloy processing schematics should be used:

1. Post homogenisation quench rate. Rapid quench rates are necessary (i.e. >400° C./hr) in order to prevent the MgSi precipitates from growing too large. This is essential to allow the complete redissolution of the MgSi during the billet heat up prior to extrusion and during the extrusion. Without this occurring, the maximum possible amount of Mg and Si may not be available for the formation of the strengthening precipitate MgSi on ageing, and the MgSi balance is altered, so that the benefits of this balance cannot be fully realised.
2. Billet preheating technique. A rapid (i.e. induction) heat-up rate is required to prevent the coarsening of the post homogenisation Mg2Si precipitates to the point where they cannot be redissolved during extrusion.
3. One possible technique with further benefits of improving extrudability and extrusion speed is to heat the billet above the Mg2Si and MgSi solvus temperature (i.e. up to say 500° C.), thereby fully dissolving any MgSi remaining, and allowing the billet to cool to the required extrusion temperature.

The above processes are applicable to all 6XXX series alloys in accordance with the invention.

Thus, the present invention also provides the following:

a) a method for treating a 6XXX series aluminium alloy comprising a homogenising heat treatment followed by a rapid quench from the homogenising temperature—preferably the rapid quench utilises cooling ratio in excess of 400° C./hr;

b) a method for extruding an extrusion feedstock comprising a 6XXX series aluminium alloy comprising rapidly heating the feedstock to prevent coarsening of post homogenisation $Mg_2Si$ precipitates in the feedstock and extruding said feedstock; and c) a method for extruding an extrusion feedstock comprising a 6XXX series aluminium alloy containing Mg and Si comprising heating said alloy above the $Mg_2Si$ and MgSi solvus temperature and allowing the feedstock to cool to the extrusion temperature and extruding said feedstock.

The feedstock in (b) and (c) above is preferably a billet.

The invention also provides a method for determining optimum content of Mg and Si in a 6XXX series aluminium alloy which comprises the steps of:

a) preparing a plurality of test samples of the alloy containing varying amounts of Mg and Si;

b) heat treating said test samples in accordance with an end-user's heat treatment protocol;

c) analysing said test samples to determine levels of $Mg_2Si$ and MgSi therein;

d) conducting testing on said samples to determine one or more mechanical properties of said test samples;

e) analysing the results obtained from steps (c) and (d) above and developing a model of Mg and Si content and heat treatment parameters of a 6XXX alloy based upon the analysis of the results of steps (c) and (d) and the precipitation sequences including precipitation of MgSi, for predicting microstructure developed in a given 6XXX alloy treated by a heat treatment process.

The method may alternatively include developing a model, using the mechanical property requirements of a particular application to determine from the model the levels of Mg and Si required in the alloy.

The procedure to calculate the optimum Mg and Si levels for specific alloys includes a number of techniques that can be applied to determine the level of availability of Mg and Si for precipitation strengthening. These are: TEM microscopy, DSC or DTA analysis, conductivity or hardness. This information can then be used to maximise the properties and extrudability by selecting the appropriate alloy composition.

It is also possible to produce an alloy specification based on an analysis of an extrusion sample and its associated thermal (processing) history. The TEM work (correlated with atom probe field ion microscopy (APFIM) results) will be used to determine levels of $Mg_2Si$ and MgSi. DSC/DTA may assist in differentiating between these precipitates. Levels of Mg (or Si) in the matrix will be identified via conductivity testing. This information will be used to develop a precipitation and microstructure "blueprint" for this alloy and process. Modifications to the alloy can then be made to optimise extrudability and mechanical properties for the operation, with the knowledge that the blueprint can be used to predict the final structure, accounting for alloy and process variations.

The APFIM correlation is necessary because TEM by itself will not be able to distinguish between $Mg_2Si$ and MgSi, i.e. the analysis of the TEM results requires an interpretation based on results from the APFIM.

Also, the interpretation of the results from the TEM, DSC/DTA, conductivity and hardness tests is not straightforward. Based upon the knowledge of the MgSi precipitation mechanism and how processing influences this, it will then be possible to "convert" the analysis of the extrusion back to an alloy specification.

From these options, it is expected to be able to develop different preferred alloys for forging applications, by tailoring the thermal history and microstructure of the aluminium to best suit the forging process.

It will be appreciated that the invention described herein is susceptible to variations and modifications other than those specifically described. It is to be understood that the invention encompasses all such variations and modifications that fall within its spirit and scope.

What is claimed is:

1. A 6XXX series aluminum alloy containing MgSi precipitates which is characterized in that the Mg and Si that is available to form MgSi precipitates is present in amounts such that the ratio of the number of atoms of Mg and the number of atoms of Si is between 0.8:1 and 1.2:1; and wherein the composition comprises, in weight %:

| | |
|---|---|
| Mg | 0.37–0.44 |
| Si | 0.56–0.63 |
| Fe | 0.2 max |
| Cu | 0.1 max |
| Mn | 0.1 max |
| Cr | 0.05 max |
| Zn | 0.15 max |
| Ti | 0.1 max |
| Balance | aluminum and incidental impurities. |

2. The alloy defined in claim 1 characterized in that the ratio of Mg:Si is between 0.9:1 and 1.1:1.

3. The alloy defined in claim 2 characterised in that the ratio of Mg:Si is 1:1.

4. A 6XXX series aluminum alloy containing MgSi precipitates which is characterized in that the Mg and Si that is available to form MgSi precipitates is present in amounts such that the ratio of the number of atoms of Mg and the number of atoms of Si is between 0.8:1 and 1.2:1; and wherein the composition comprises, in weight %:

i) Mg and Si concentrations in an area bounded by the following co-ordinates on a Mg/Si co-ordinate diagram, with straight lines connecting the co-ordinates:

| Mg | Si |
|---|---|
| 0.35 | 0.48 |
| 0.35 | 0.58 |
| 0.44 | 0.7 |
| 0.58 | 0.7; and |
| ii) the following elements, in weight %: | |
| Fe | 0.1–0.2 |
| Cu | 0.1 max |
| Mn | 0.03 max |
| Cr | 0.03 max |
| Zn | 0.10 max |
| B | 0.06 max |
| Balance: | aluminum and incidental impurities (0.05 max each, 0.10 max total). |

5. A method of manufacturing an extruded product from a 6XXX series aluminum alloy which comprises the steps of:

i) casting a billet of a 6XXX series aluminum alloy containing Mg and Si as defined in claim 4;

ii) extruding a final product shape from the billet; and iii) heat treating the extruded product shape and precipitating MgSi.

6. A method of manufacturing a forged product from a 6XXX series aluminum alloy which comprises the steps of:

i) casting a billet of a 6XXX series aluminum alloy containing Mg and Si as defined in claim 4;

ii) forging a final product shape from the billet; and iii) heat treating the alloy and precipitating MgSi.

7. The method as defined in claim 6 further comprises the step of extruding an intermediate product shape from the billet and thereafter forging the final product shape.

8. The alloy defined in claim 4 characterized in that the ratio of Mg:Si is between 0.9:1 and 1.1:1.

9. The alloy defined in claim 8 characterized in that the ratio of Mg:Si is 1:1.

* * * * *